US009829836B2

(12) United States Patent
Shibuya

(10) Patent No.: US 9,829,836 B2
(45) **Date of Patent: *Nov. 28, 2017**

(54) IMAGE FORMING APPARATUS WITH PRE-EXPOSURE MEMBER

(71) Applicant: CANON KABUSHIKI KAISHA, Tokyo (JP)

(72) Inventor: Kenichi Shibuya, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/185,672

(22) Filed: Jun. 17, 2016

(65) Prior Publication Data

US 2016/0291510 A1 Oct. 6, 2016

Related U.S. Application Data

(63) Continuation of application No. PCT/JP2014/084771, filed on Dec. 19, 2014.

(30) Foreign Application Priority Data

Dec. 20, 2013 (JP) ..... 2013-263296
Dec. 18, 2014 (JP) ..... 2014-256720

(51) Int. Cl.
*G03G 15/16* (2006.01)
*G03G 15/01* (2006.01)
*G03G 21/08* (2006.01)

(52) U.S. Cl.
CPC ..... *G03G 15/1665* (2013.01); *G03G 15/0189* (2013.01); *G03G 21/08* (2013.01); *G03G 2215/0129* (2013.01)

(58) Field of Classification Search
None
See application file for complete search history.

(56) References Cited

U.S. PATENT DOCUMENTS 6,738,588 B2 5/2004 Yokomori et al.
9,417,566 B2 8/2016 Shibuya
2006/0274628 A1* 12/2006 Tanaka ..... G03G 15/1605 369/100

FOREIGN PATENT DOCUMENTS

JP 09-185193 A 7/1997
JP 2002-049167 A 2/2002
JP 2002-189400 A 7/2002
JP 2004-341420 A 12/2004
JP 2007-127711 A 5/2007
(Continued)

OTHER PUBLICATIONS

JP_2008310311_A_T Machine Translation JP Dec. 2008 Gondo.*
(Continued)

*Primary Examiner* — Victor Verbitsky
(74) *Attorney, Agent, or Firm* — Fitzpatrick, Cella, Harper & Scinto

(57) ABSTRACT

In an image forming apparatus including a plurality of image forming stations, a pre-exposure device is not provided in at least a most upstream image forming station at which a toner image formed by the image forming station cannot arrive, and the pre-exposure device is provided in at least a most downstream image forming station at which the toner image formed by the image forming station can arrive.

17 Claims, 11 Drawing Sheets

(56) References Cited

FOREIGN PATENT DOCUMENTS

| | | | | |
|---|---|---|---|---|
| JP | 2008-026791 | A | | 2/2008 |
| JP | 2008026791 | A | * | 2/2008 |
| JP | 2008310311 | A | * | 12/2008 |

OTHER PUBLICATIONS

JP_2008026791_A_T 2008 Yashima Japan.*

* cited by examiner

IMAGE FORMING APPARATUS WITH PRE-EXPOSURE MEMBER

TECHNICAL FIELD

The present invention relates to an image forming apparatus. As this image forming apparatus, for example, it is possible to cite image forming apparatuses such as a copying machine, a printer, a facsimile (FAX) machine, and a multi-function machine having a plurality of functions of these machines.

BACKGROUND ART

In recent years, a so-called tandem type image forming apparatus including a plurality (four) of image forming stations has been proposed. Such an image forming apparatus is capable of quickly forming a color image using an electrophotographic process, and therefore, receives attention.

In each image forming station, around a photosensitive member, a charging device (charging means), an exposure device (exposure means) and developing device (developing means) are provided. Further, toner images formed at the respective image forming stations are successively transferred superposedly onto an intermediary transfer member (image receiving member), and thereafter, are transferred onto a recording material altogether.

Here, as a type of the charging device, two types, i.e., an "AC charging type" for (electrically) charging the photosensitive member by applying a superposed voltage of an AC voltage and a DC voltage and a "DC charging type" for (electrically) charging the photosensitive member by applying only the DC voltage have been known.

The "AC charging type" is advantageous in that a surface of the photosensitive member can be uniformly charged compared with the "DC charging type", but a discharge amount to the photosensitive member is large and therefore the photosensitive member tends to be liable to deteriorate. Further, an expensive AC voltage (power) source is needed. On the other hand, compared with the "AC charging type", in the "DC charging type", the photosensitive member does not readily deteriorate, but tends to be inferior in charging uniformity. That is, compared with the "DC charging type", the "AC charging type" is high in initial costs and running costs. In other words, compared with the "AC charging type", the "DC charging type" is advantageous in terms of the running costs and the initial costs.

Therefore, in the case where the "DC charging type" is intended to be employed, the following problems can generate.

Specifically, in an apparatus described in Japanese Laid-Open Patent Application 2002-189400, in order to lower a potential (residual potential) of the photosensitive member remaining after transfer to the neighborhood of 0 V, a device for optically discharging the photosensitive member, a so-called pre-exposure device (discharging means), is mounted. Thus, in the case where a method of discharging the photosensitive member by using the pre-exposure device is employed, in the charging device, the photosensitive member has to be charged from the neighborhood of 0 V to a desired potential (e.g., −700 V), and compared with the case where a discharging step by the pre-exposure device is not performed, a discharge current becomes large. That is, compared with the case where the discharging step by the pre-exposure device is not performed, the photosensitive member tends to be liable to deteriorate.

On the other hand, in the case where the discharging step is not performed without providing the pre-exposure device (there is an advantage of cost reduction), the photosensitive member only has a discharging effect by a transfer device. This discharging effects depends on a toner image formed in a preceding image forming station, i.e., an amount of a toner which is a resistor, and in the case where this amount is large, the step goes to a subsequent charging step while the photosensitive member little has the discharging effect. Particularly, when each of toner images formed in first and second image forming stations has a maximum density (two color solid images), in transfer steps of third and fourth image forming stations, the photosensitive members little have the discharging effect. Resulting from this, there is a liability that a ghost image (defective image) generates on a subsequent image. That is, in the third and fourth stations, from their arrangement viewpoint, a density of a coming toner image tends to become high, so that there is a liability that the ghost image can generate.

On the other hand, in the first image forming station, from its arrangement viewpoint, there is no coming toner image, and therefore there is no liability that the ghost image generates.

SUMMARY OF THE INVENTION

An object of the present invention is to provide an image forming apparatus capable of suppressing generation of image defect while reducing costs.

Another object will become apparent by reading the following detailed description while making reference to the attached drawings.

A first invention is an image forming apparatus comprising: a first image forming station including a first photosensitive member, charging means configured to charge the first photosensitive member, first exposure means configured to expose the first photosensitive member charged by the first charging means to light on the basis of first image data, and a first developing means configured to develop with a toner an electrostatic latent image formed on the first photosensitive member by the first exposure means; a second image forming station including a second photosensitive member, second charging means configured to charge the second photosensitive member by being supplied with only a DC voltage, second exposure means configured to expose the second photosensitive member charged by the second charging means to light on the basis of second image data, and a second developing means configured to develop with a toner an electrostatic latent image formed on the second photosensitive member by the second exposure means; and transfer means configured to electrostatically transfer superposedly a toner image formed on the first photosensitive member and a toner image formed on the second photosensitive member onto an image receiving member in this order, wherein the first image forming station is not provided with discharging means configured to optically discharge the first photosensitive member, and the second image forming station is provided with discharging means configured to optically discharge the second photosensitive member.

A second invention is an image forming apparatus comprising: a first image forming station including a first photosensitive member, first charging means configured to charge the first photosensitive member, first exposure means configured to expose the first photosensitive member charged by the first charging means to light on the basis of first image data, and a first developing means configured to develop with a toner an electrostatic latent image formed on the first photosensitive member by the first exposure means; a second image forming station including a second photosensitive member, second charging means configured to charge the second photosensitive member, second exposure means configured to expose the second photosensitive member charged by the second charging means to light on the basis of second image data, and a second developing means configured to develop with a toner an electrostatic latent image formed on the second photosensitive member by the second exposure means; a third image forming station including a third photosensitive member, third charging means configured to charge the third photosensitive member by being supplied with only a DC voltage, third exposure means configured to expose the third photosensitive member charged by the third charging means to light on the basis of third image data, and a third developing means configured to develop with a toner an electrostatic latent image formed on the third photosensitive member by the third exposure means; a fourth image forming station including a fourth photosensitive member, fourth charging means configured to charge the fourth photosensitive member by being supplied with only a DC voltage, fourth exposure means configured to expose the fourth photosensitive member charged by the fourth charging means to light on the basis of fourth image data, and a fourth developing means configured to develop with a toner an electrostatic latent image formed on the fourth photosensitive member by the fourth exposure means; and transfer means configured to electrostatically transfer superposedly a toner image formed on the first photosensitive member, a toner image formed on the second photosensitive member, a toner image formed on the third photosensitive member, and a toner image formed on the fourth photosensitive member onto an image receiving member in this order, wherein the first image forming station and the second image forming station are not provided with discharging means, respectively, configured to optically discharge corresponding ones of the photosensitive members, and the third image forming station and the fourth image forming station are provided with discharging means, respectively, configured to optically discharge corresponding ones of the photosensitive members.

A third invention is an image forming apparatus comprising: a first image forming station including a first photosensitive member, first charging means configured to charge the first photosensitive member, first exposure means configured to expose the first photosensitive member charged by the first charging means to light on the basis of first image data, and a first developing means configured to develop with a toner an electrostatic latent image formed on the first photosensitive member by the first exposure means; a second image forming station including a second photosensitive member, second charging means configured to charge the second photosensitive member by being supplied with only a DC voltage, second exposure means configured to expose the second photosensitive member charged by the second charging means to light on the basis of second image data, and a second developing means configured to develop with a toner an electrostatic latent image formed on the second photosensitive member by the second exposure means; a third image forming station including a third photosensitive member, third charging means configured to charge the third photosensitive member by being supplied with only a DC voltage, third exposure means configured to expose the third photosensitive member charged by the third charging means to light on the basis of third image data, and a third developing means configured to develop with a toner an electrostatic latent image formed on the third photosensitive member by the third exposure means; a fourth image forming station including a fourth photosensitive member, fourth charging means configured to charge the fourth photosensitive member by being supplied with only a DC voltage, fourth exposure means configured to expose the fourth photosensitive member charged by the fourth charging means to light on the basis of fourth image data, and a fourth developing means configured to develop with a toner an electrostatic latent image formed on the fourth photosensitive member by the fourth exposure means; and transfer means configured to electrostatically transfer superposedly a toner image formed on the first photosensitive member, a toner image formed on the second photosensitive member, a toner image formed on the third photosensitive member, and a toner image formed on the fourth photosensitive member onto an image receiving member in this order, wherein the first image forming station is not provided with discharging means, respectively, configured to optically discharge corresponding ones of the photosensitive members, and the second image forming station, the third image forming station and the fourth image forming station are provided with discharging means, respectively, configured to optically discharge corresponding ones of the photosensitive members.

EMBODIMENTS FOR CARRYING OUT THE INVENTION

In the following, embodiments according to the present invention will be described based on the attached drawings.

Embodiment 1

Figure 4:
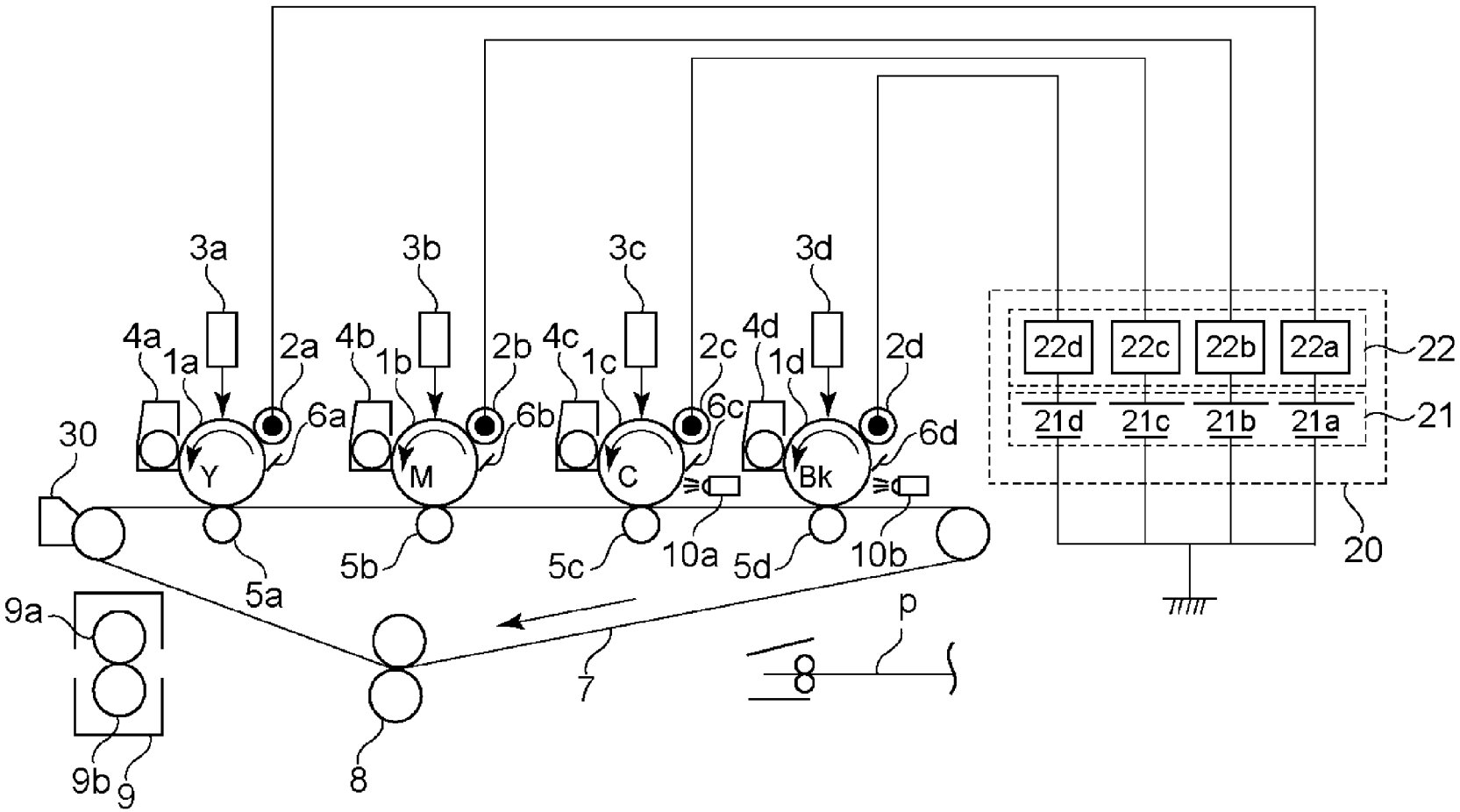
FIG. 4 is a schematic illustration of the image forming apparatus according to the embodiment.

FIG. 4 is a schematic illustration showing an image forming apparatus according to the present invention. Incidentally, as the image forming apparatus, the present invention is applicable to image forming apparatuses such as copying machine, a printer, a FAX machine, and a multi-function machine having a plurality of functions of these machines, and in this embodiment, a full-color printer will be described as an example. First, details of image forming stations mounted in the image forming apparatus will be described.

(Image Forming Station)

The image forming apparatus includes a plurality (four) of image forming stations, and these four image forming stations are arranged with certain intervals along a movement direction of an intermediary transfer belt 7. The four image forming stations are image forming stations Y, M, C and Bk for colors of yellow (first), magenta (second), cyan (third) and black (fourth), respectively. Further, in the following, in the case where the colors are abbreviated as Y, M, C and Bk, these colors mean yellow, magenta, cyan and black, respectively.

In upstream image forming stations (first image forming stations) Y and M, photosensitive members (hereinafter also referred to as photosensitive drums) 1*a* and 1*b* are provided, respectively. Further, at peripheries of the respective photosensitive drums 1*a* and 1*b*, charging rollers 2*a* and 2*b* which are charging devices (charging means), exposure devices (exposure means) 3*a* and 3*b*, developing devices (developing means) 4*a* and 4*b*, and cleaning devices (cleaning means) 6*a* and 6*b* are provided.

In downstream image forming stations (second image forming stations) C and Bk, photosensitive members 1*c* and 1*d* are provided, respectively. Further, at peripheries of the respective photosensitive drums 1*c* and 1*d*, charging rollers 2*c* and 2*d* which are charging devices (charging means), exposure devices (exposure means) 3*c* and 3*d*, developing devices (developing means) 4*c* and 4*d*, and cleaning devices (cleaning means) 6*c* and 6*d* are provided.

(Photosensitive Member)

Figure 2:
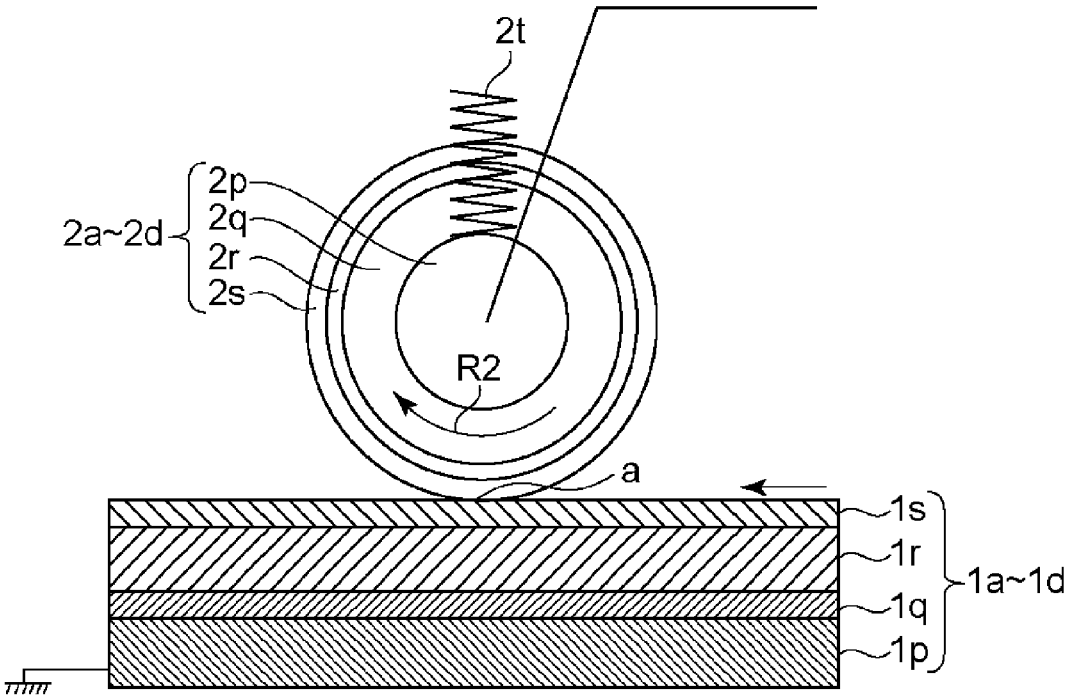
FIG. 2 is a view for illustrating a layer structure of a charging roller and a layer structure of a photosensitive drum of an image forming apparatus according to an embodiment.

The photosensitive drums 1*a*-1*d* are negatively chargeable organic photosensitive members (OPCs) of 30 mm in outer diameter in this embodiment, and are rotationally driven in arrow directions at a process speed of 210 mm/s in general by drive of a driving device (not shown). The photosensitive drums 1*a*-1*d* are, as shown in FIG. 2, constituted by applying, onto a surface of an aluminum-made cylinder (electroconductive drum substrate) 1*p*, 3 layers of an undercoat layer 1*q* for suppressing light interference and for improving an adhesive property to an upper layer, a photo-charge generation layer 1*r* and a charge transport layer is in this order from below.

(Charging Device)

The charging rollers 2*a*, 2*b*, 2*c* and 2*d* uniformly charge the surfaces of the photosensitive drums 1*a*, 1*b*, 1*c* and 1*d* by DC voltages applied from an unshown high-voltage circuit (charging bias voltage source). The charging rollers are provided so as to be contactable to the photosensitive drums. In this embodiment, the charging bias was −1300 V, and a potential (Vd; dark-portion potential (potential of a portion which is not subjected to image exposure)) was set so as to be −700 V at a developing position of the developing device by charging the photosensitive drum by electric discharge from the charging roller.

Specifically, the charging rollers 2*a*-2*d* charge the surfaces of the photosensitive drums 1*a*-1*d* to a predetermined potential by a charging bias (only a DC voltage) applied from the high-voltage circuit (charging bias voltage source) 20. Specifically, to the charging rollers 2*a*-2*d*, a DC voltage of a negative polarity identical to the normal output polarity of the toner is applied, so that the surfaces of the photosensitive drums 1*a*-1*d* are charged to the negative polarity.

The bias (voltage) is generated by a combination of the high-voltage circuit 20, a DC voltage generating circuit 21 and DC voltage amplifying circuit 22. In FIG. 4, DC voltages applied to the charging rollers 2*a*-2*d* of the respective image forming stations are applied by the DC voltage generating circuits 21*a*, 21*b*, 21*c* and 21*d* in the DC voltage generating circuit 21. Further, magnitudes of DC voltage values thereof are adjusted by the DC voltage amplifying circuits 22*a*, 22*b*, 22*c* and 22*d* in the DC voltage amplifying circuit 22.

In this embodiment, as already described above, the DC charging type (in which the voltage applied to the charging device is only the DC voltage) which can generate a ghost image instead of suppression of costs was employed. Incidentally, as described above, when the AC charging type (in which the voltage applied to the charging device is the superposed voltage of the DC voltage and the AC voltage) is employed, a photosensitive drum residual potential smoothing effect is large, and therefore, although the ghost image does not readily generate, it constitutes a factor of an increase in cost.

Further, longitudinal lengths (lengths in which the charging rollers contact the photosensitive drums) of the charging rollers 2*a*-2*d* are 320 mm, and as shown in FIG. 2, each charging roller 2 has a 3-layer structure in which around a core metal 2*p* (supporting member), layers including an undercoat layer 2*q*, an intermediary layer 2*r* and a surface layer 2*s* are successively laminated from a lower side. The undercoat layer 2*q* is a foamed sponge layer for reducing a charging noise, and the surface layer 2*s* is a protective layer provided for preventing generation of leak even when the photosensitive drum has defects such a pinhole thereon.

Specifically, the specifications of the charging rollers 2*a*-2*d* in this embodiment are as follows:

Core metal 2*p*: round stainless rod of 6 mm in diameter

Undercoat layer 2*q*: foamed EPDM in which carbon black particles were dispersed, and which is 0.5 g/cm$^3$ in specific gravity, $10^2$-$10^9\Omega$ in volume resistivity, and 3.0 mm in thickness Intermediary layer 2*r*: NBR rubber in which carbon black particles were dispersed, and which is $10^2$-$10^5\Omega$ in volume resistivity, and 700 μm in thickness Surface layer 2*s*: fluorine-containing resin in which tin oxide particles and carbon black particles were dispersed, and which is $10^7$-$10^{10}\Omega$ in volume resistivity, 1.5 μm in surface roughness (10 point surface roughness Ra according to JIS), and 10 μm in thickness The charging rollers 2*a*-2*d* are urged toward a center of the photosensitive drums by urging springs 2*t*, so that the charging rollers are press-contacted to the surfaces of the photosensitive drums with a predetermined urging force at charging nips a, and are rotated by the rotational drive of the photosensitive drums in a direction of R2 in the figure.

In this embodiment, an entire volume resistivity, of the charging rollers 2*a*-2*d*, of $1.0\times10^5\Omega$ was employed.

(Exposure Device)

The exposure devices 3*a*-3*d* are laser beam scanners using a semiconductor laser. The exposure devices 3*a*-3*d* output laser lights modulated correspondingly to image signals inputted from a host processing device such as an unshown image reading device. The laser lights scan the charged surfaces of the photosensitive drums 1*a*-1*d*, so that electrostatic latent images depending on the inputted image signals are formed on the photosensitive members. In this embodiment, a light portion potential (VL) at a portion where the photosensitive drums 1*a*-1*d* are irradiated with the laser lights was −200 V.

(Developing Device)

In the developing devices (developing means) 4*a*, 4*b*, 4*c* and 4*d*, yellow, magenta, cyan and black toners, respectively, having a negative polarity as a normal charge polarity are accommodated.

To the developing devices 4*a*, 4*b*, 4*c* and 4*d*, a superposed developing bias of a DC voltage (Vdc) and with an AC voltage (Vac) is applied. Specifically, in this embodiment, the developing bias is 8 kHz in frequency of the AC voltage, is −550 V in the DC voltage, and is 1800 V in peak-to-peak voltage Vpp of the AC voltage. The charge polarity of the toner is the negative polarity, and therefore, the toner is deposited on the light portion of the photosensitive drums by the developing devices through a reverse development type.

(Transfer Device)

Further, at a lower portion of the respective image forming stations (respective photosensitive members), primary transfer rollers (transfer member) 5*a*, 5*b*, 5*c* and 5*d* which are transfer devices (transfer means) are provided opposed to the photosensitive drums via the intermediary transfer belt 7 which is the image receiving member. These primary transfer rollers 5*a*-5*d* have a constitution in which they rotate while pressing the intermediary transfer belt 7 toward the photosensitive members 1*a*-1*d*.

(Image Forming Sequence)

An image forming sequence at the respective image forming stations is performed through an electrophotographic process. Image forming processes in all the image forming stations are substantially the same, and therefore, the image forming process (sequence) of the Y image forming station will be described as a representative.

First, the surface of the photosensitive drum 1*a* is charged substantially uniformly to the negative potential by the charging roller 2*a*. At this time, to the charging roller 2*a*, only a DC voltage is applied. Next, on the basis of Y image data, the exposure device 3*a* subjects the photosensitive drum 1*a* to image exposure, so that the electrostatic image is formed on the photosensitive drum 1*a*. Thereafter, the electrostatic image on the photosensitive drum 1*a* is developed with the toner by the developing device 4*a*, so that the toner image is formed on the photosensitive drum 1*a*.

Thus, the color toner images formed on the photosensitive drums 1*a*, 1*b*, 1*c* and 1*d*, respectively, are electrostatically transferred in this order superposedly onto the intermediary transfer belt 7 which is the image receiving member (transfer receiving member) by the respective transfer rollers 5*a*-5*d*. A voltage (DC voltage) applied to each of the transfer rollers 5*a*-5*d* is a voltage of a positive polarity which is an opposite polarity to the normal charge polarity of the toner. That is, the polarity of the voltage applied to each of the transfer rollers 5*a*-5*d* is an opposite polarity to the polarity of the voltage applied to each of the charging rollers 2*a*-2*d*.

Further, the toner images for the four colors transferred superposedly on the intermediary transfer belt 7 are transferred altogether onto the recording material P, fed by a paper (sheet) feeding mechanism, by a secondary transfer roller 8 which is a transfer mechanism. At this time, to the secondary transfer roller 8, a DC voltage of the positive polarity is applied.

Thereafter, the recording material P separated from the secondary transfer roller 8 is subjected to a fixing process by a fixing device 9. Specifically, in a fixing nip roller 9*a* and a pressing roller 9*b*, a full-color toner image is heated and pressed, and is fixed on the recording material P. Thereafter, the recording material P is discharged to an outside of the image forming apparatus. Incidentally, the toner, on the intermediary transfer belt 7, which has not been completely transferred by the secondary transfer roller 8 is removed by a cleaner 30.

Figure 3:
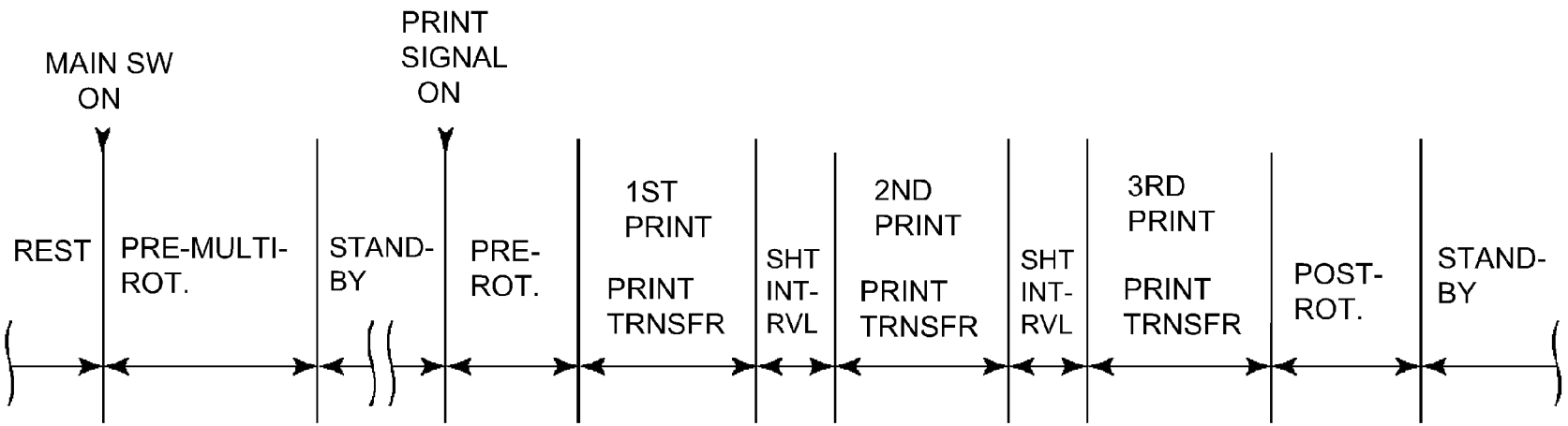
FIG. 3 is an operation sequence diagram of the image forming apparatus according to the embodiment.

FIG. 3 is a time chart of the image forming sequence.

a. Initial Rotation Operation (Pre-Multi-Rotation Step)

This period is an actuation operation period during actuation of the printer (activation operation period, warming-up period). Preparatory operations (warming-up operations) of predetermined process devices, such as rise of the fixing device 9 to a predetermined temperature by rotationally driving the photosensitive members 1*a*-1*d* through turning-on of a main power switch are carried out.

b. Preparatory Rotation Operation for Printing (Pre-Rotation Step)

This period is a preparatory rotation operation period from print signal-ON until an image forming (print) step is actually performed, and when a print signal is inputted during the initial rotation operation, the preparatory rotation operation for printing is carried out subsequently to the initial rotation operation. When no print signal is inputted, drive of a main motor is temporarily stopped after the end of the initial rotation operation, the rotational drive of the photosensitive drum 1 is stopped, and the printer is kept in a stand-by (waiting) state until a print signal is inputted. When the print signal is inputted, the preparatory rotation operation for printing is carried out.

c. Printing Step (Image Forming Step, Imaging Step)

When the predetermined preparatory rotation operation for printing is ended, subsequently, an image forming process to the photosensitive drums 1*a*-1*d* is carried out, so that primary transfer of the toner images formed on the photosensitive drums 1*a*-1*d* onto the intermediary transfer belt 7, secondary transfer onto the recording material P, and the fixing process are made and the printing step is ended.

In the case of continuous printing (continuous print) mode, the above-described printing step is repeatedly carried out correspondingly to a preset print number n.

d. Sheet Interval Step

This step is a period in which no recording material P is in the secondary transfer position after a trailing edge of a preceding recording material (sheet) passes through the secondary transfer position until a leading edge of a subsequent recording material (sheet) reaches the secondary transfer portion.

e. Post-Rotation Operation

This period is a period in which the drive of the main motor is continued for a while even after the printing step onto the final recording material is ended and the photosensitive drums 1*a*-1*d* are rotationally driven, so that a predetermined post-process operation is carried out.

f. Stand-by

When the predetermined post-rotation operation is ended, the drive of the main motor is stopped and the rotational drive of the photosensitive drums 1*a*-1*d* is stopped, and the printer is kept in the stand-by state until a next print signal is inputted.

In the case of print of only one sheet, the printer is put through the post-rotation operation after the printing is ended, and is in a stand-by state.

In the stand-by state, when the print signal is inputted, the printer goes to the pre-rotation step.

The above-described printing process c is performed during image formation, and the initial rotation operation a, the pre-rotation operation b, the sheet interval d, and the post-rotation operation e are performed during non-image formation.

(With Regard to Ghost Phenomenon)

In such a tandem-type image forming apparatus, for example, it is assumed that a red image (called R patch) obtained by superposing Y (yellow) and M (magenta) toners (maximum deposition amount, so called solid) is formed. Thereafter, in the case where an HT image (half tone image, also referred to as CHT) in the image forming station for C (cyan) is formed, a phenomenon occurs that the CHT image partly generates at a position after one full turn of the photosensitive drum 1*c* from passing of the R patch through a transfer position (position of the primary transfer roller 5*c*).

This phenomenon will be described using (b) of FIG. 10 which is a simplified view of FIG. 4. The R patch formed at the Y and M image forming stations of FIG. 4 is conveyed by the intermediary transfer belt 7 and reaches the transfer position between the photosensitive drum 1*c* and the primary transfer roller of the C image forming station.

Figure 10:
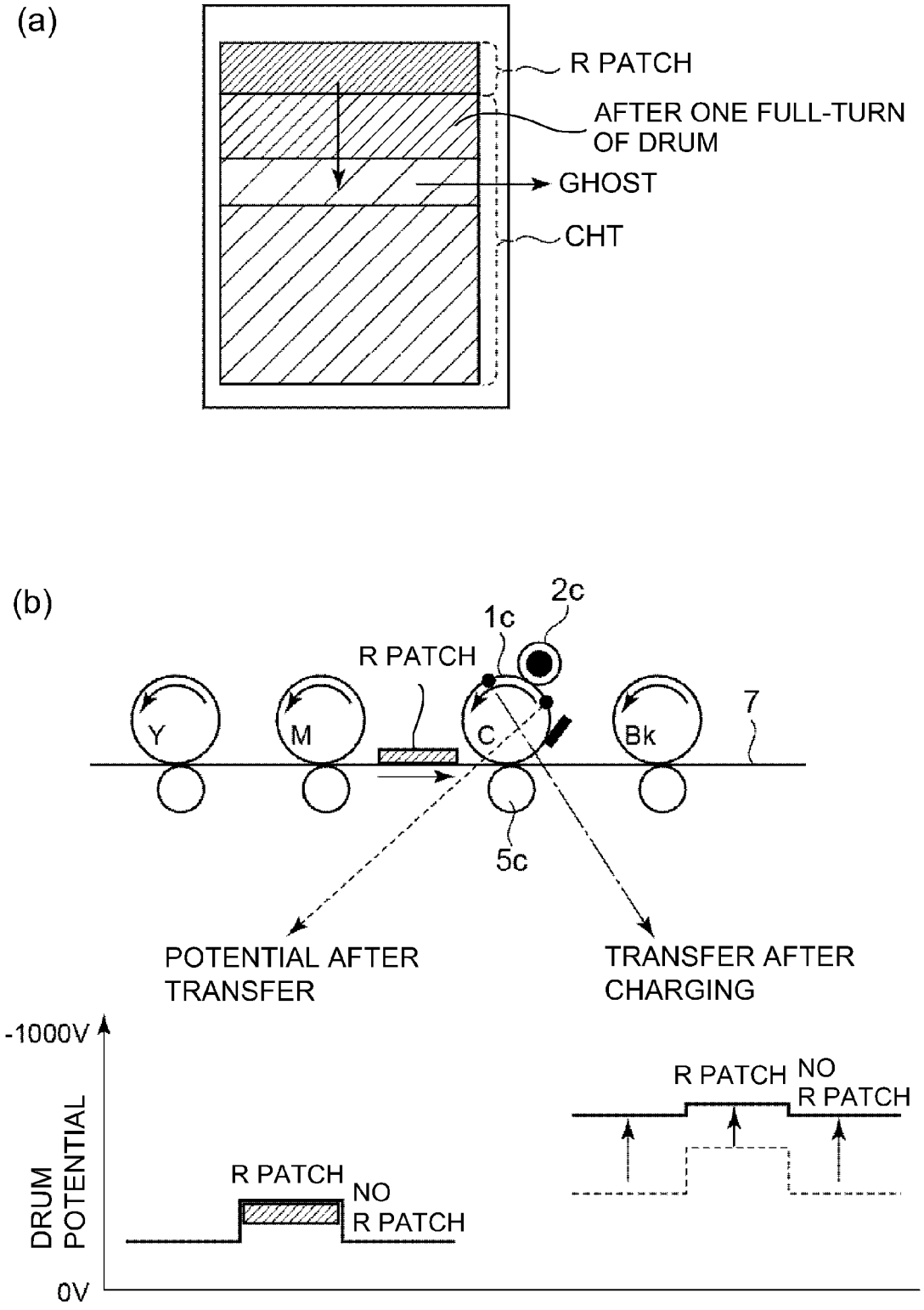
In FIG. 10, (a) is a view showing an image example of a transfer ghost, and (b) is a view for illustrating a generation mechanism of the transfer ghost.

The ordinate of a graph at a lower portion of (b) of FIG. 10 shows a surface potential (negative potential) of the photosensitive drum 1*c*. Then, at a portion where the R patch exists, compared with a portion where there is no R patch, a residual potential of the photosensitive drum 1*c* after the primary transfer becomes high in a negative side. This is caused by that the toner of the R patch is the resistor as described above. That is, at the portion where the R patch exists, compared with the portion where there is no R patch, a current flowing when the primary transfer bias (positive voltage) is applied becomes small, and thus the above phenomenon is caused by that the residual potential of the photosensitive drum 1*c* does not completely lower toward a zero-potential (0 V).

Figure 1:
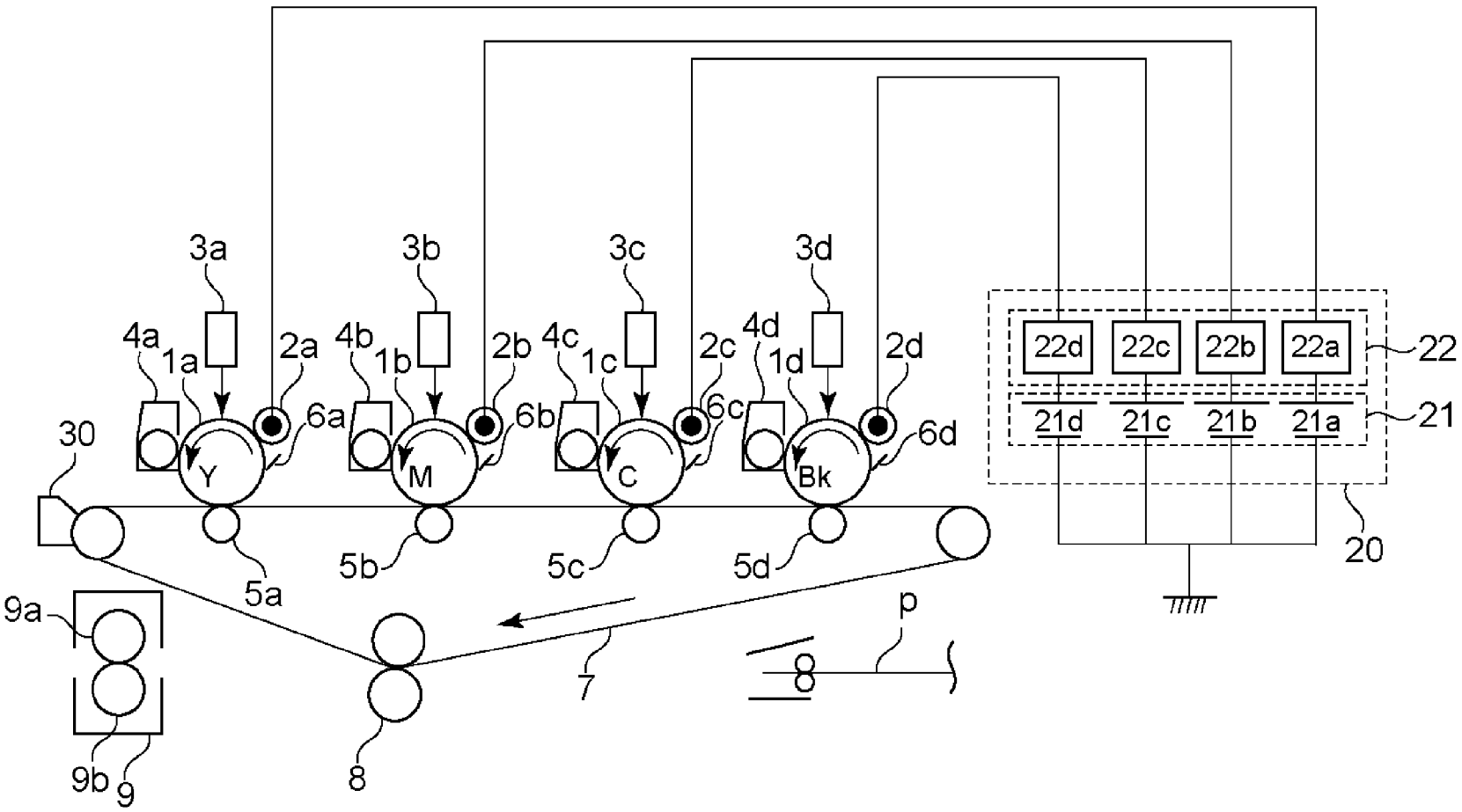
FIG. 1 is a schematic illustration of an image forming apparatus in which a pre-exposure device is not provided in all of image forming stations.

Then, in the case of the image forming apparatus as shown in FIG. 1 in which the pre-exposure device is not provided at all the image forming stations, thereafter even the photosensitive drum 1*c* is subjected to the charging process by the charging roller 2*c*, a difference in residual potential slightly remains as a hysteresis thereof. As a result thereof, the residual potential difference is to be capable of being recognized as a ghost on an image subsequently formed on the photosensitive drum 1*c*. This will be referred to as a ghost phenomenon.

This ghost phenomenon is, as described above, a phenomenon that generates when the toner formed at the upstream image forming station passes through the transfer position of the downstream image forming station. Further, the more the amount of the toner image formed at the upstream image forming station, the more this ghost phenomenon is liable to conspicuously generate. In this embodiment, the toner amount when the R (red) image is formed with the Y toner and the M toner is capable of having the influence on image formation of C and Bk (black). Further, the toner amount when a G (green) image is formed with the Y toner and the C toner or the toner amount when a B (blue) image is formed with the M toner and the C toner is capable of having the influence on image formation of Bk.

Thus, in the case where an image of a secondary color (the case where the toners of two colors are superposed) such as R, G or B comes to the primary transfer position of the downstream image forming station, when the toner amount of the secondary color is large, generation of the ghost phenomenon is conspicuous in the downstream (C, Bk) image forming stations.

Therefore, in this embodiment, as shown in FIG. 4, only at the C and Bk image forming stations (second image forming stations), the pre-exposure device as a discharging means was provided. 10*a* is the pre-exposure device for irradiating the photosensitive drum 1*c* with light between the transfer position of the transfer roller 5*c* and the charging position of the charging roller 2*c* with respect to a rotational direction of the photosensitive drum 1*c*. That is, the pre-exposure device 10*a* performs the function of lowering the potential of the photosensitive drum 1*c* to the neighborhood of 0 V uniformly by optically discharging the whole surface of the photosensitive drum 1*c*. Further, 10*b* is the pre-exposure device for irradiating the photosensitive drum 1*d* with light between the transfer position of the transfer roller 5*d* and the charging position of the charging roller 2*d* with respect to a rotational direction of the photosensitive drum 1*d*. That is, the pre-exposure device 10*d* performs the function of lowering the potential of the photosensitive drum 1*d* to the neighborhood of 0 V uniformly by optically discharging the whole surface of the photosensitive drum 1*d*.

In this embodiment, the pre-exposure devices 10*a* and 10*b* employ LEDs arranged in a longitudinal direction of the photosensitive drums 1*c* and 1*d*, and were 630 mm in peak wavelength and 130 μW in light quantity.

As the light quantity, a value (μW) measured by using an optical power meter TQ8210 manufactured by Advantest Corp. and by causing a light receiving portion of the power meter to oppose the pre-exposure devices 10*a* and 10*b* on the surfaces of the photosensitive drums 1*c* and 1*d* which are remotest from the photosensitive drums 10*a* and 10*b* was used.

Further, timing of irradiation with pre-exposure light was during the printing step c. and during the sheet interval step d. of FIG. 3. That is, a region of the photosensitive drum which is subjected to the transfer and the charging was irradiated with the pre-exposure light.

By employing the above constitution, a post-transfer potential of the photosensitive drum of the downstream image forming station by the toner image coming from the upstream image forming station is made uniform to the neighborhood of 0 V by the pre-exposure devices 10*a* and 10*b* irrespective of the toner amount. Accordingly, in the downstream image forming station, the generation of the ghost phenomenon is suppressed.

Further, in the first and second image forming stations for Y and M, a large potential difference after the transfer and a large potential difference after the charging as in the graph at the lower portion of (b) of FIG. 10 did not generate. Accordingly, in the Y and M image forming stations, pre-exposure devices corresponding to 10*a* and 10*b* are not provided.

Incidentally, in the M image forming station, some potential difference after the transfer generates by passing of the toner image formed in the upstream Y image forming station. However, a maximum toner amount of Y (corresponding to one color) is remarkably small compared with the toner amount of the R patch (corresponding to two colors), and therefore the potential difference after the charging as shown in (b) of FIG. 10 does not generate, so that the ghost phenomenon did not generate in the M image forming station.

Accordingly, in this embodiment, the pre-exposure device is not provided in the Y and M image forming stations, and the pre-exposure devices (10*a*, 10*b*) are provided in the C and Bk image forming stations. Therefore, while employing the DC charging type capable of enjoying a cost reduction effect, all the image forming stations are not required to be provided with the pre-exposure device, and therefore it is possible to suppress the generation of the ghost phenomenon while reducing the costs.

Embodiment 2

Next, Embodiment 2 will be described. A basic constitution of an image forming apparatus is the same as that of Embodiment 1, and therefore, will be omitted from detailed description by adding the same reference numerals or symbols.

In Embodiment 2, a point that on/off (actuation/non-actuation) of the pre-exposure devices (10*a*, 10*b*) provided in the downstream image forming station (C, Bk) is controlled on the basis of the toner images (toner amounts) formed in the upstream image forming stations (Y, M), i.e., on the basis of image data for Y and image data for M, is largely different.

When the ghost phenomenon is suppressed in the downstream image forming stations (C, Bk), as in Embodiment 1, in the case where the pre-exposure devices 10*a* and 10*b* are turned on irrespective of the image data for Y (to which the toner amount of Y corresponds) and the image data for M (to which the toner amount of M corresponds), the turning-on of the pre-exposure devices is disadvantageous in some instances.

This is because subjection to light irradiation from the photosensitive drums 10*a* and 10*b* constitutes a factor of deterioration promotion of the photosensitive drums 1*c* and 1*d*. That is, the potentials of the photosensitive drums 1*c* and 1*d* before the charging step are made uniform to the neighborhood of 0 V by the pre-exposure devices 10*a* and 10*b*, and therefore, the potential difference becomes large before and after the charging step. By this potential difference, a discharge current amount by the charging devices 2*c* and 2*d* becomes large, so that discharge damage on the photosensitive drums 1*c* and 1*d* becomes large. As a result thereof, the photosensitive drums 1*c* and 1*d* become worse in dark-decay characteristic (a surface potential lowering speed becomes faster than at an initial stage), and due to this, there is an increasing liability that improper charging generates when the DC charging is made by the charging devices 2*c* and 2*d*. Further, the photosensitive drums 1*c* and 1*d* are liable to abrade at rubbing (sliding) portions such as cleaning devices (blades) 6*c* and 6*d*.

Specifically, in the case of the constitution of Embodiment 1, the photosensitive drums 1*c* and 1*d* of the C and Bk image forming stations had an abrasion amount (decreased in film thickness of a photosensitive layer) which was 1.5 times that of the photosensitive drums 1*a* and 1*b* of the Y and M image forming stations.

Figure 5:
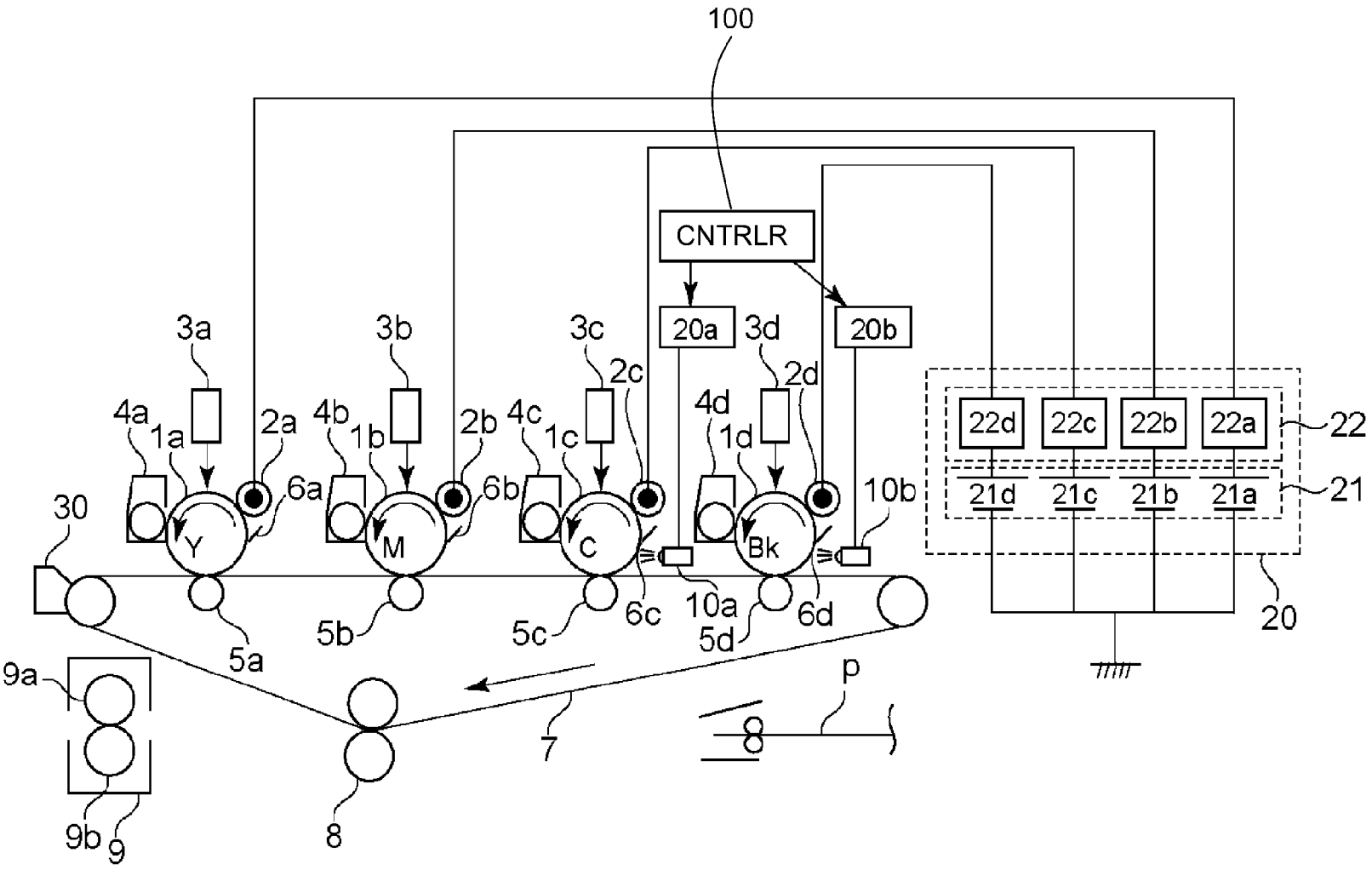
FIG. 5 is a schematic illustration of an image forming apparatus according to an embodiment.

Therefore, in this embodiment, as shown in FIG. 5, pre-exposure controlling devices (functioning as a part of control means) 20*a* and 20*b* for controlling operations (on/off) of the pre-exposure devices 10*a* and 10*b* are provided. That is, in Embodiment 1, the pre-exposure devices were always turned on in a region subjected to the transfer and the charging, but in Embodiment 2, the pre-exposure devices 10*a* and 10*b* were turned off depending on a condition.

Figure 6:
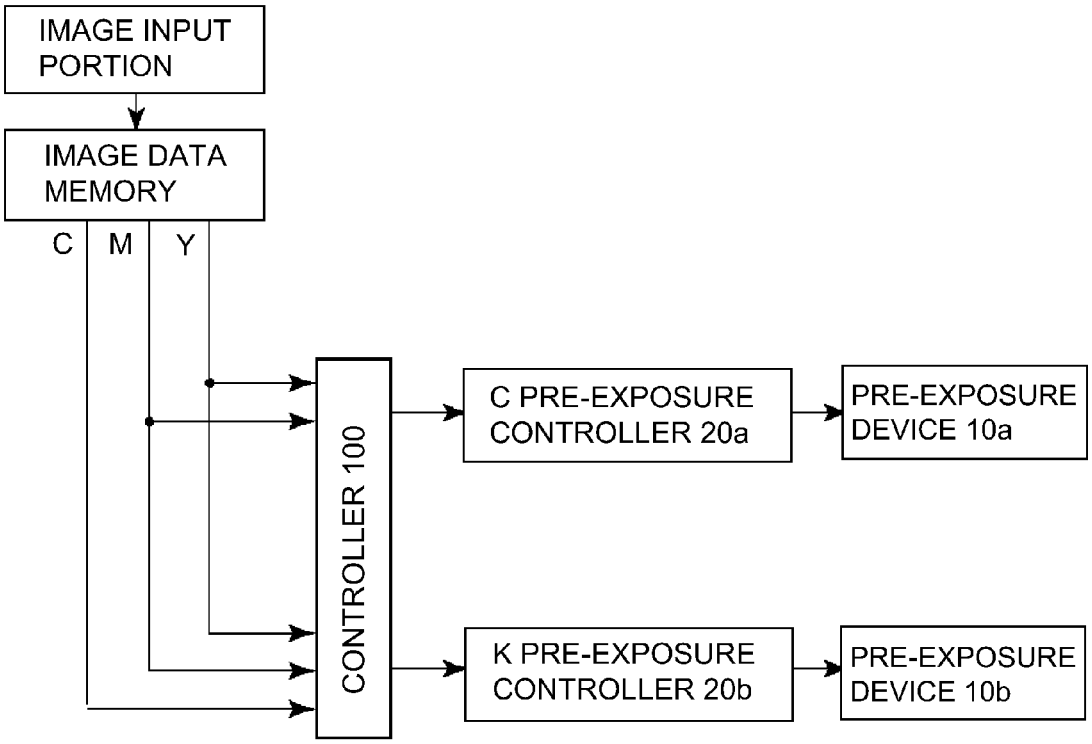
FIG. 6 is a block diagram of the image forming apparatus according to the embodiment.

FIG. 6 shows a block diagram in this embodiment. Image data sent from a host computer (e.g., a PC) communication-connected with the image forming apparatus (printer) via a network cable are inputted into an image input portion and then are stored in an image data memory. Then, of the image data stored in the image data memory, the image data of Y, M and C are transmitted to a controller (control means) 100.

Incidentally, in the case where the image forming apparatus has a copying function, image data of an original read by a mounted original reading device are inputted into the image input portion, and subsequent steps are the same as those in the case of the above-described printer.

Then, on the basis of whether the sum of the toner amount of Y corresponding to the Y image data of the image data and the toner amount of M corresponding to the M image data of the image data is not less than a predetermined amount or less than the predetermined amount, the on/on of the pre-exposure devices 10*a* and 10*b* is controlled. Specifically, whether or not a maximum value of the sum of image signals which are image information of an overlapping portion of the image data of Y and M is not less than a predetermined value A is discriminated by the controller (CPU) 100. Incidentally, the overlapping portion of the image data corresponds to an overlapping region of the Y toner and the M toner on the intermediary transfer belt 7 (recording material P).

In this embodiment, the image data were obtained by measuring a reflection density of a solid image (maximum density image) formed on the recording material P by a spectral densitometer (503 manufactured by X-Rite Inc.) (in which a reflection density of 1.4 corresponding to the toner of one color is taken as the maximum density), and if the image signal is in a range of 0-255, the image signal 255 was set so as to be the reflection density of 1.4.

Further, in this embodiment, the predetermined amount A was the case where the image signal at the overlapping portion of the Y image signal and the M image signal was 450 (maximum image signal (maximum toner deposition amount) of Y and M was 510).

Further, a flow in which whether or not a maximum value of the sum of image signals which are image information at an overlapping portion of the image data of Y, M and C in not less than a predetermined value B is discriminated by the controller 100 is used in combination.

In this embodiment, the predetermined value B was the case where an image signal at an overlapping portion of the image signals Y, M and C was 450 (maximum (maximum toner deposition amount) of the sum of Y, M and C was 510). Thus, in consideration of fixing process power in the fixing device 9, a maximum total toner deposition amount in the case where Y and M overlap with each other and a total maximum toner deposition amount in the case where Y, M and C overlap with each other are set at the same value.

(Control Sequence of Photosensitive Drum)

In this embodiment, in the case where not less than the predetermined values A and B is discriminated by the controller 100, the information is transmitted to the pre-exposure controlling devices 20*a* and 20*b*, and the pre-exposure controlling devices 20*a* and 20*b* provide operation instructions for turning on the photosensitive drums 10*a* and 10*b*, respectively.

That is, in the case where in a certain downstream image forming station (e.g., the Bk image forming station), the amount of the toner passing through the transfer position thereof on the intermediary transfer belt 7 is large (in the case where the maximum value of the sum of the image signals is not less than the predetermined value), the ghost phenomenon is liable to generate, and therefore, the pre-exposure devices are turned on.

On the other hand, in the case where in the certain image forming station (e.g., the Bk image forming station), the amount of the toner passing through the transfer position thereof on the intermediary transfer belt 7 is small (in the case where the maximum value of the sum of the image signals is less than the predetermined value), the ghost phenomenon does not readily generate, and therefore, the pre-exposure devices are turned off.

Thus, whether the pre-exposure devices are turned on or off is discriminated by the controller 100 depending on the amount of the toner conveyed to the associated transfer position by the intermediary transfer belt 7.

Figure 7:
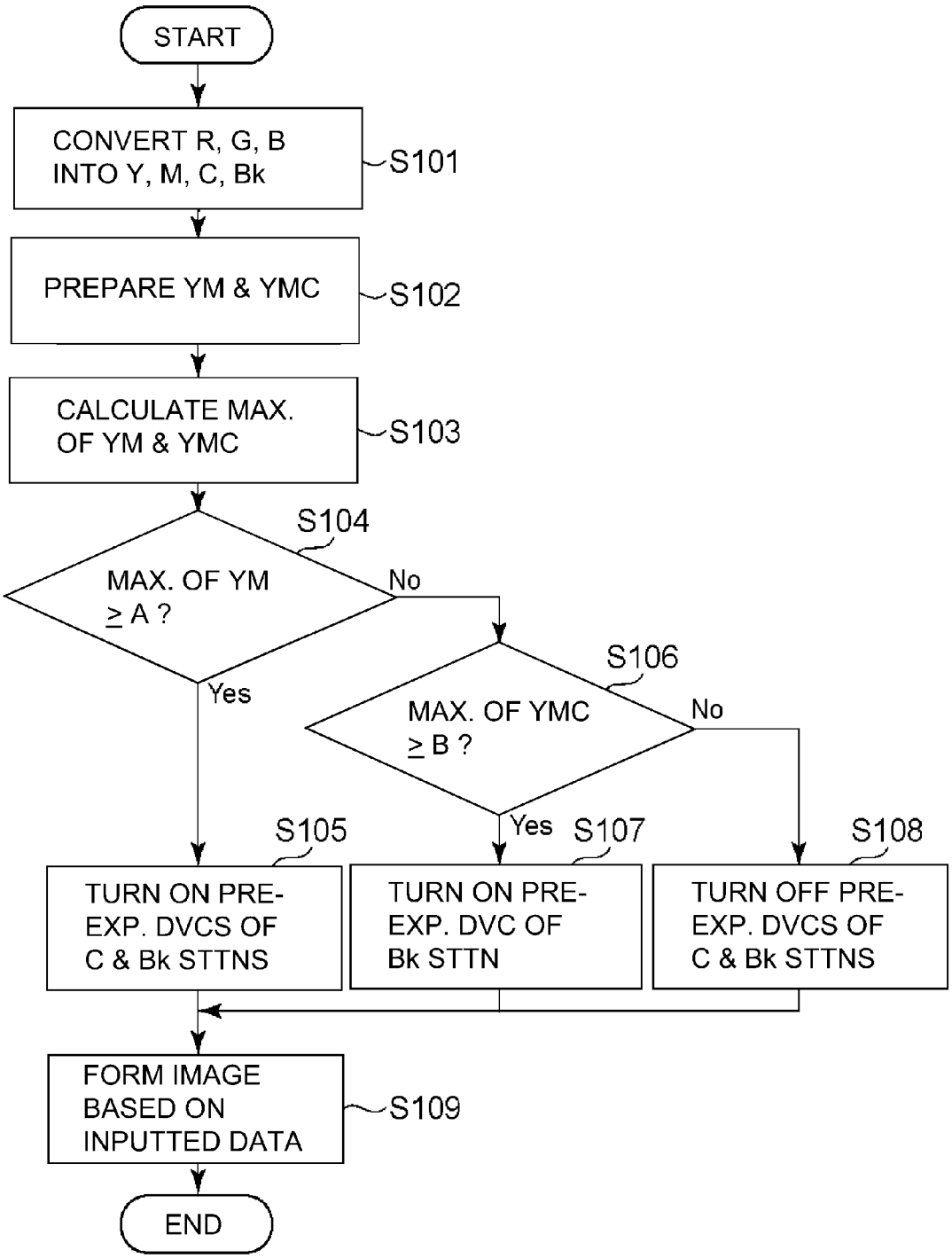
FIG. 7 is a flowchart for illustrating an operation of the image forming apparatus according to the embodiment.

FIG. 7 shows an operation flow.

In the image forming apparatus of FIG. 5, when image formation is started, inputted image data (image data of R, G and B) are converted into image data of Y, M, C and Bk in an image data converting portion in the controller 100 (S101). Of the converted image data, image data YM obtained by synthesizing the Y and M image data and image data YMC obtained by synthesizing the Y, M and C image data are prepared by the controller 100 (S102).

Next, amount values of the image data YM and the image data YMC are calculated by the controller 100 (S103).

Next, whether the maximum value of the image data YM is not less than the predetermined value A is discriminated by the controller 100 (S104). Thus, the discrimination is made using the image data in the two image forming stations (Y, M) in the upstream side.

When the maximum amount is not less than the predetermined amount A, the pre-exposure devices 20*a* and 20*b* of the C and Bk image forming stations positioned downstream of the Y and M image forming stations are turned on (S105).

In S104, when the maximum amount is less than the predetermined amount A, whether or not the maximum amount of the image data YMC is not less than the predetermined value B is discriminated by the controller 100 (S106). Thus, the discrimination is made using the image data in the image forming stations (Y, M, C) other than the most downstream Bk image forming station.

When the maximum amount is not less than the predetermined amount B, the pre-exposure device 20*b* of the Bk image forming station positioned downstream of Y, M and C image forming stations is turned on (S107).

In S106, when the maximum amount is less than the predetermined amount B, the pre-exposure device of the C and Bk image forming stations are still turned off even at desired timing (S108). Next, after the on/off discriminations of the pre-exposure devices in S105, S107 and S108, on the basis of the inputted image data, the respective color images are formed at the respective image forming stations (S109).

Incidentally, a light irradiation condition by the pre-exposure device was, similarly as in Embodiment 1, 630 nm in peak wavelength and 130 μW in light quantity. Further, the turning-on timing of the pre-exposure device was periods of the printing step c. and the sheet interval step d. in FIG. 3.

As described above, control in which the photosensitive drum of the downstream image forming station is turned on only in the case where the toner in a predetermined amount or more comes from the upstream image forming station and in other cases, the light irradiation by the pre-exposure device is not effected is made. As a result, it is possible to not only suppress the generation of the ghost phenomenon in the downstream image forming station but also prolong a lifetime of the photosensitive member of the downstream image forming station.

Embodiment 3

Next, Embodiment 3 will be described. A basic constitution of an image forming apparatus is the same as those of Embodiments 1 and 2, and therefore, will be omitted from detailed description by adding the same reference numerals or symbols.

In Embodiment 3, compared with the control constitution of Embodiment 2, a point that a charging bias (negative DC voltage) applied to the charging rollers 2*c* and 2*d* is switched between the case where the pre-exposure devices (10*a*, 10*b*) provided in the downstream image forming stations (C, Bk) are turned on and the case where the pre-exposure devices are turned off, is largely different.

This is because the density of the image formed in the downstream image forming station changes between the case of turning-off of the pre-exposure device and the case of turning-on of the pre-exposure device.

Figure 8:
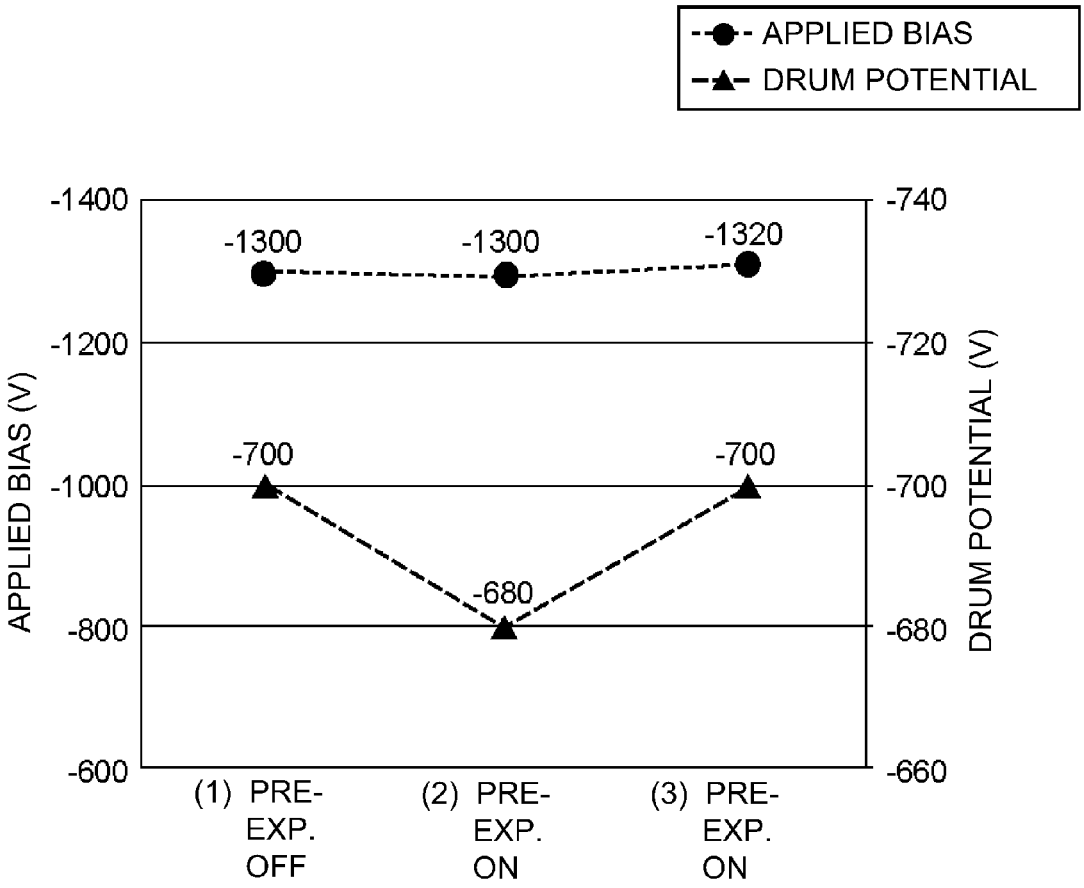
FIG. 8 is a graph showing a relationship of execution and non-execution of pre-exposure with an applied charging bias and a charge potential on a photosensitive drum in an image forming apparatus according to an embodiment.

FIG. 8 shows a relationship between an "applied charging bias" to the charging roller 2*c* (left ordinate) and a "charging potential on photosensitive drum (Vd)" at the developing position (position opposing 4*c*) of the photosensitive drum 1*c* (right ordinate) in the case of turning-on of the pre-exposure device 10*a* of the c image forming station and in the case of turning-off of the pre-exposure device 10*a*.

First, in the case where the pre-exposure device 10*a* is turned off in (1), the applied charging bias is −1300 V, whereas Vd is −700 V. Under the condition, in the case where the pre-exposure device 10*a* is turned on in (2), the applied charging bias was −1300 V, whereas the potential of the photosensitive drum 1*c* at the developing position was −680 V.

The reason why a difference (20 V) generates between the potentials of this photosensitive drum 1*c* is that there is a difference in dark-decay characteristic between the case where the pre-exposure device 10*a* is turned off and the case where the pre-exposure device 10*a* is turned on. This dark-decay characteristic is, as described above, a phenomenon that after the photosensitive member is charged to a desired potential by the charging device, the potential of the photosensitive member naturally lowers with lapse of time.

In the case where the pre-exposure device 10*c* is turned on, the potential of the photosensitive drum 1*c* is optically discharged to the neighborhood of 0 V, and therefore, in the photosensitive drum 1*c*, a photo-carrier tends to generate in a larger amount than during the light irradiation by the exposure device 3*c* for effecting the image exposure. In the case where the light irradiation is effected by the exposure device 3*c*, this photo-carrier flows from the electroconductive substrate of the photosensitive drum 1*c* toward the earth (grounding), but in the case where the light irradiation is effected by the pre-exposure device 10*a*, the photo-carrier remains in the photosensitive drum 1*a* although an amount thereof is slight.

Therefore, in the case where the pre-exposure device 10*a* is turned on, compared with the case where the pre-exposure device 10*a* is turned off, by a residual photo-carrier in the photosensitive drum 1*c*, the dark-decay phenomenon until the charged portion reaches the developing position (position opposing 4*c*) becomes large. That is, in the case where the pre-exposure device 10*a* is turned on, compared with the case where the pre-exposure device 10*a* is turned off, the charge potential of the photosensitive drum 1*c* lowers in larger degree (absolute value). As a result, in the case where the pre-exposure device 10*a* is turned on, compared with the case where the pre-exposure device 10*a* is turned off, there is a liability that the toner image density becomes dense unintendedly.

Therefore, in this embodiment, such an unintended fluctuation of the image density is corrected. That is, as shown in (3) of FIG. 8, the applied charging bias may preferably be switched from −1300 V to −1320 V. In other words, the applied charging bias applied to the charging device 2*c* in the case where the pre-exposure device 10*a* is turned on is switched so as to be larger in absolute value than that in the case where the pre-exposure device 10*a* is turned off.

Incidentally, in the above, the C image forming station was specifically described, but also with regard to the Bk image forming station including the pre-exposure device 10*b*, the applied charging bias applied to the charging device 2*d* may preferably be switched similarly.

Thus, in order to correct the above-described density fluctuation, in this embodiment, the following control was employed specifically.

Figure 9:
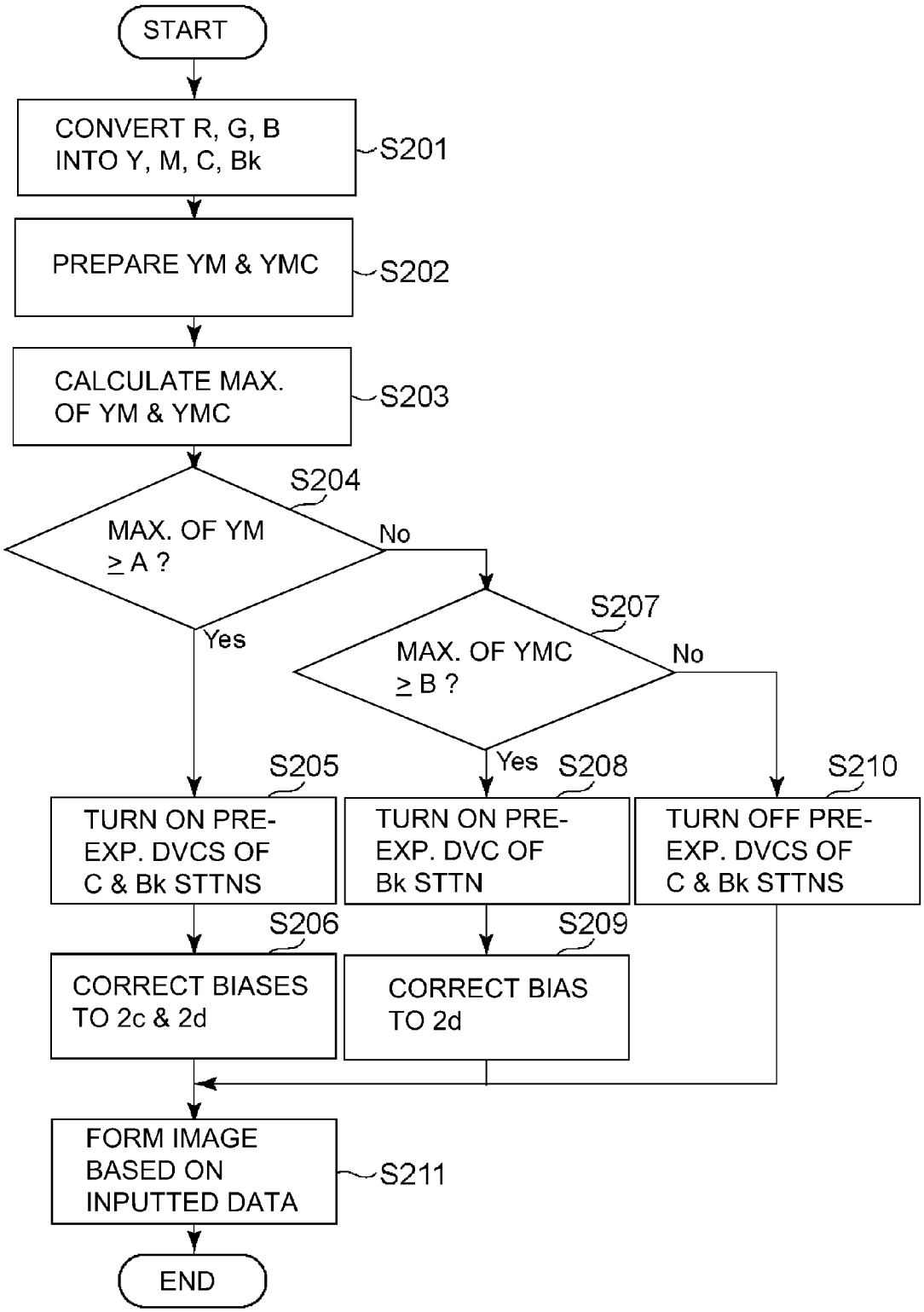
FIG. 9 is a flowchart for illustrating an operation of the image forming apparatus according to the embodiment.

FIG. 9 is an operation flow.

In the image forming apparatus of FIG. 5, when image formation is started, inputted image data (image data of R, G and B) are converted into image data of Y, M, C and Bk in an image data converting portion in the controller 100 (S201).

Of the converted image data, image data YM obtained by synthesizing the Y and M image data and image data YMC obtained by synthesizing the Y, M and C image data are prepared by the controller 100 (S202).

Next, amount values of the image data YM and the image data YMC are calculated by the controller 100 (S203).

Next, whether the maximum value of the image data YM is not less than the predetermined value A is discriminated by the controller 100 (S204). Thus, the discrimination is made using the image data in the two image forming stations (Y, M) in the upstream side.

Thereafter, as described above, the applied bias to the charging rollers 2*c* and 2*d* is corrected. In this embodiment, the applied bias was changed from −1300 V to −1320 V (S206).

In S204, when the maximum amount is less than the predetermined amount A, whether or not the maximum amount of the image data YMC is not less than the predetermined value B is discriminated (S207).

When the maximum amount is not less than the predetermined amount B, the pre-exposure device 20*b* of the Bk image forming station positioned downstream of Y, M and C image forming stations is turned on (S208).

Thereafter, as described above, the applied bias to the charging roller 2*d* is corrected. In this embodiment, the applied bias was corrected from −1300 V to −1320 V (S209).

In S207, when the maximum amount is less than the predetermined amount B, the pre-exposure devices 10*a* and 10*b* of the C and Bk image forming stations are set to be turned off (S210).

After the on/off discriminations of the pre-exposure devices and the applied charging bias correcting step in S206, S209 and S210, on the basis of the inputted image data, the respective color images are formed at the respective image forming stations (S211). Incidentally, a light irradiation condition for the pre-exposure device was, similarly as in Embodiment 1, 630 nm in peak wavelength and 130 μW in light quantity. Further, the light irradiation by the pre-exposure device was effected in periods of the printing step c. and the sheet interval step d. in FIG. 3.

Thus, in this embodiment, in addition to the advantage of the constitution of Embodiment 2, it becomes possible to suppress the fluctuation in image density in the case where the pre-exposure device is turned on.

In the above, the image forming apparatuses according to the present invention were described in Embodiments 1 to 3, but the present invention is not limited to such embodiments, and within the scope of ideas of the present invention, various constitutions can be replaced with other constitutions.

Figure 11:
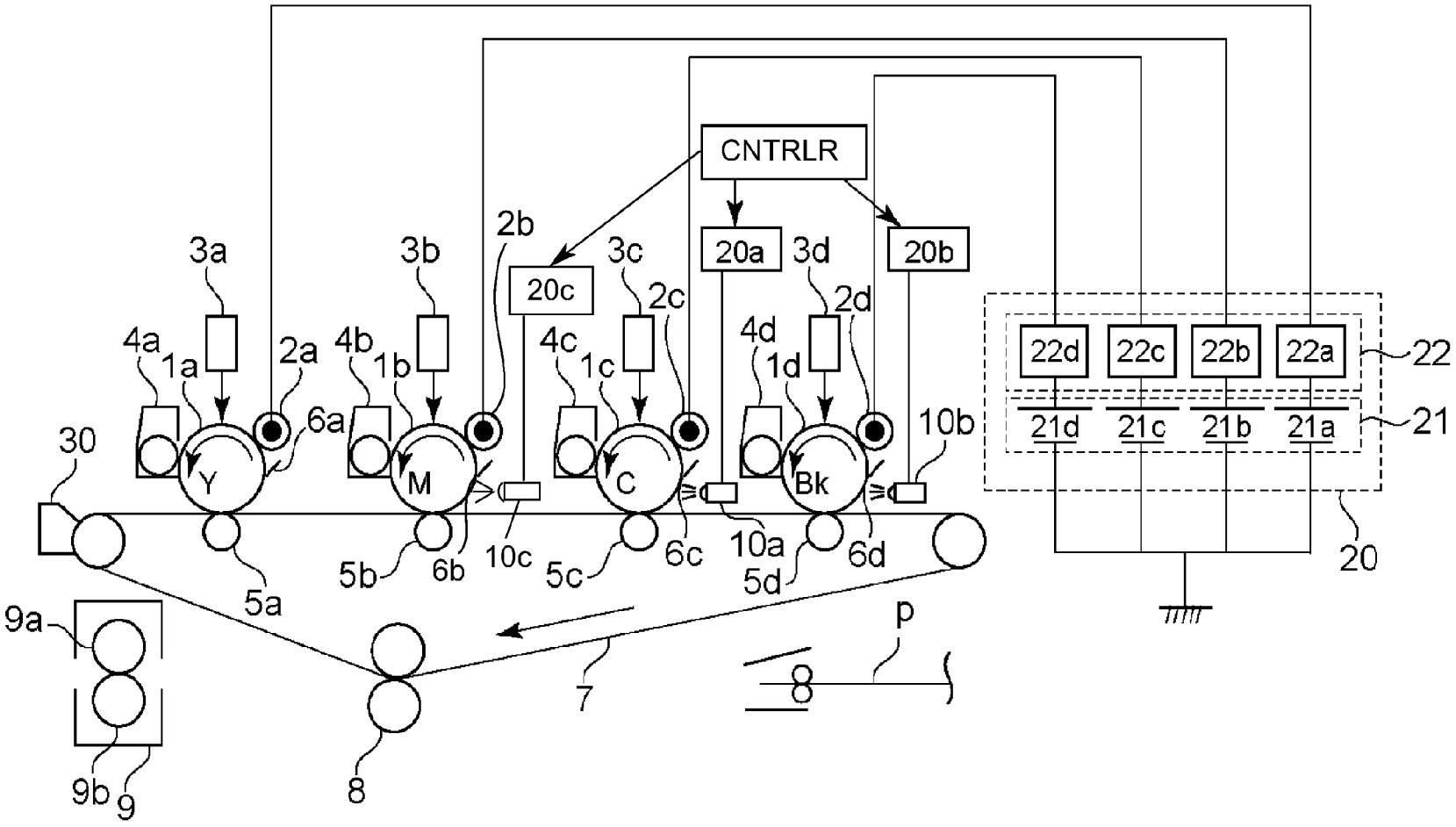
FIG. 11 is a schematic illustration of an image forming apparatus according to another embodiment.

For example, in Embodiments 1 to 3, of the four image forming stations of Y, M, C and Bk, the constitution in which only the image forming stations of C and Bk are provided with the pre-exposure device was employed, but the present invention is not limited to such an exposure means. That is, as shown in FIG. 11, a constitution in which only the image forming stations of M, C and Bk, excluding the most upstream image forming station of the four image forming stations of Y, M, C and Bk, are provided with the pre-exposure devices may also be employed. In this case, in the case where there is a liability that the amount of the Y toner coming to the transfer position of the image forming station of M is large and the ghost phenomenon generates in the image forming station of M similarly as in Embodiments 1 to 5, the above constitution is effective.

Further, in Embodiments 1 to 3, the example in which there are four (Y, M, C, Bk) image forming stations was described, but for example, the present invention is also similarly applicable to even an embodiment in which there are three (Y, M, C) image forming stations or an embodiment in which there are five or more image forming stations.

Further, in the case of the embodiment in which there are three image forming stations Y, M and C, similarly as in the above-described Embodiments 2 to 3, on the basis of the Y image data and the M image data, ON/OFF of the pre-exposure device of the C image forming station may preferably be controlled.

Further, in the case of the embodiment in which there are five or more image forming stations, similarly as in the above-described Embodiments 2 to 3, ON/OFF control of the pre-exposure device in the associated image forming station may preferably be effected on the basis of the image data in the image forming station positioned upstream of the associated image forming station with respect to the movement direction of the intermediary transfer belt 7.

Further, in Embodiment 3, in order to suppress the image density fluctuation due to the ON/OFF of the pre-exposure device, the applied charging bias applied to the charging device is corrected (adjusted), but instead thereof, the light-portion potential (VL) may also be changed by correcting (adjusting) light irradiation intensity by the exposure device. However, a potential lowering (absolute value) generates with respect to the dark-portion potential (Vd) on the photosensitive drum, and therefore as in Embodiment 3, it is further preferable that the applied charging bias is adjusted.

Further, in Embodiments 1 to 3, the pre-exposure device employed the LEDs arranged in the longitudinal direction of the photosensitive drums, but may also employ LEDs having another constitution. For example, a constitution in which LEDs are provided in both end sides one by one with respect to the rotational axis direction (longitudinal direction) and lights from these LEDs are used for light irradiation of the photosensitive drums substantially in the entire area with respect to the rotational axis direction of the photosensitive drums through light guiding members (light guides) may also be employed.

Further, in Embodiments 2 and 3, the photosensitive drum was subjected to the ON/OFF control, but instead thereof, although the photosensitive drum is turned on in either case, the light irradiation amount (light quantity) may also be switched between the case where the light irradiation amount is increased and the case where the light irradiation amount is made smaller than that in the case of the increase. However, this constitutes a factor of deterioration promotion of the photosensitive members, and therefore the above-described Embodiments 2 and 3 are more preferable.

Further, in Embodiments 1 to 3, as the pre-exposure device, the LEDs are employed, but the pre-exposure device is not limited thereto, and may also be another irradiation means such as a lamp.

Further, in Embodiments 1 to 3, the constitution in which the charging roller which is the charging device is disposed in contact with the photosensitive member surface is employed, but the present invention is not limited thereto, and a constitution in which the charging roller is disposed near to the photosensitive member surface through a small gap may also be employed.

INDUSTRIAL APPLICABILITY

According to the present invention, there is provided an image forming apparatus capable of suppressing generation of image defect while reducing costs.

The invention claimed is:

1. An image forming apparatus comprising:

an image input portion into which image data corresponding to toner images to be formed is inputted;

a first image forming station including a first photosensitive member, a first charging roller configured to charge said first photosensitive member at a first charging position, a first exposure member configured to expose said first photosensitive member charged by said first charging roller to light on the basis of, among the image data inputted into said image input portion, first image data corresponding to a first toner image formed at said first image forming station, and a first developing device configured to develop with a toner an electrostatic latent image formed on said first photosensitive member by said first exposure member;

a second image forming station including a second photosensitive member, a second charging roller configured to charge said second photosensitive member at a second charging position by being supplied with only a DC voltage, a second exposure member configured to expose said second photosensitive member charged by said second charging roller to light on the basis of, among the image data inputted into said image input portion, second image data corresponding to a second toner image formed at said second image forming station, and a second developing device configured to develop with a toner an electrostatic latent image formed on said second photosensitive member by said second exposure member;

an intermediary transfer belt configured to bear the first toner image and the second toner image which are transferred superposedly in the listed order;

a first transfer member disposed opposed to said first photosensitive member via said intermediary transfer belt and configured to electrostatically transfer the first toner image formed on said first photosensitive member onto said intermediary transfer belt at a first transfer position;

a second transfer member disposed opposed to said second photosensitive member via said intermediary transfer belt and configured to electrostatically transfer the second toner image formed on said second photosensitive member onto said intermediary transfer belt at a second transfer position, wherein said first image forming station is not provided with a pre-exposure member configured to expose said first photosensitive member to light at a position downstream of the first transfer position and upstream of the first charging position with respect to a movement direction of said first photosensitive member, and said second image forming station is provided with said pre-exposure member configured to expose said second photosensitive member to light at a position downstream of the second transfer position and upstream of the second charging position with respect to a movement direction of said second photosensitive member; and a controller configured to control an operation of said pre-exposure member depending on the first image data, wherein said controller controls the operation of said pre-exposure member when image formation is effected using the first image data and the second image data.

2. An image forming apparatus according to claim 1, wherein said controller actuates said pre-exposure member when a toner amount corresponding to the first image data is not less than a predetermined amount and does not actuate said pre-exposure member when the toner amount corresponding to the first image data is less than the predetermined amount.

3. An image forming apparatus according to claim 1, wherein a voltage of an opposite polarity to a charge polarity of the toner is applied to said first transfer member when the first toner image is transferred from said first photosensitive member to said intermediary transfer belt and is applied to said second transfer member when the second toner image is transferred from said second photosensitive member to said intermediary transfer belt.

4. An image forming apparatus comprising:

an image input portion into which image data corresponding to toner images to be formed is inputted;

a first image forming station including a first photosensitive member, a first charging roller configured to charge said first photosensitive member at a first charging position, a first exposure member configured to expose said first photosensitive member charged by said first charging roller to light on the basis of, among the image data inputted into said image input portion, first image data corresponding to a first toner image formed at said first image forming station, and a first developing device configured to develop with a toner an electrostatic latent image formed on said first photosensitive member by said first exposure member;

a second image forming station including a second photosensitive member, a second charging roller configured to charge said second photosensitive member at a second charging position, a second exposure member configured to expose said second photosensitive member charged by said second charging roller to light on the basis of, among the image data inputted into said image input portion, second image data corresponding to a second toner image formed at said second image forming station, and a second developing device configured to develop with a toner an electrostatic latent image formed on said second photosensitive member by said second exposure member;

a third image forming station including a third photosensitive member, a third charging roller configured to charge said third photosensitive member at a third charging position by being supplied with only a DC voltage, a third exposure member configured to expose said third photosensitive member charged by said third charging roller to light on the basis of, among the image data inputted into said image input portion, third image data corresponding to a third toner image formed at said third image forming station, and a third developing device configured to develop with a toner an electrostatic latent image formed on said third photosensitive member by said third exposure member;

a fourth image forming station including a fourth photosensitive member, a fourth charging roller configured to charge said fourth photosensitive member at a fourth charging position by being supplied with only a DC voltage, a fourth exposure member configured to expose said fourth photosensitive member charged by said fourth charging roller to light on the basis of, among the image data inputted into said image input portion, fourth image data corresponding to a fourth toner image formed at said fourth image forming station, and a fourth developing device configured to develop with a toner an electrostatic latent image formed on said fourth photosensitive member by said fourth exposure member;

an intermediary transfer belt configured to bear the first toner image, the second toner image, the third toner image and the fourth toner image which are transferred superposedly in the listed order;

a first transfer member disposed opposed to said first photosensitive member via said intermediary transfer belt and configured to electrostatically transfer the first toner image formed on said first photosensitive member onto said intermediary transfer belt at a first transfer position;

a second transfer member disposed opposed to said second photosensitive member via said intermediary transfer belt and configured to electrostatically transfer the second toner image formed on said second photosensitive member onto said intermediary transfer belt at a second transfer position;

a third transfer member disposed opposed to said third photosensitive member via said intermediary transfer belt and configured to electrostatically transfer the third toner image formed on said second photosensitive member onto said intermediary transfer belt at a third transfer position; and a fourth transfer member disposed opposed to said fourth photosensitive member via said intermediary transfer belt and configured to electrostatically transfer the fourth toner image formed on said fourth photosensitive member onto said intermediary transfer belt at a fourth transfer position, wherein said first image forming station and said second image forming station are not provided with a pre-exposure member, respectively, configured to expose corresponding ones of said photosensitive members to light at a position downstream of the first transfer position and upstream of the first charging position with respect to a movement direction of said first photosensitive member and at a position downstream of the second transfer position and upstream of the second charging position with respect to a movement direction of said second photosensitive member, respectively, and said third image forming station and said fourth image forming station are provided with a first pre-exposure member and a second pre-exposure member, respectively, configured to expose corresponding ones of said photosensitive members to light at a position downstream of a third transfer position and upstream of a third charging position with respect to a movement direction of said third photosensitive member and at a position downstream of a fourth transfer position and upstream of a fourth charging position with respect to a movement direction of said fourth photosensitive member, respectively.

5. An image forming apparatus according to claim 4, comprising a controller configured to control an operation of said first pre-exposure member depending on the first image data and the second image data.

6. An image forming apparatus according to claim 5, wherein said controller actuates said first pre-exposure member when a sum of a toner amount corresponding to the first image data and a toner amount corresponding to the second image data is not less than a predetermined amount and does not actuate said first pre-exposure member when the sum is less than the predetermined amount.

7. An image forming apparatus according to claim 4, comprising a controller configured to control an operation of said second pre-exposure member depending on the first image data, the second image data and the third image data.

8. An image forming apparatus according to claim 7, wherein said controller actuates said second pre-exposure member when a sum of a toner amount corresponding to the first image data, a toner amount corresponding to the second image data and a toner amount corresponding to the third image data is not less than a predetermined amount and does not actuate said second pre-exposure member when the sum is less than the predetermined amount.

9. An image forming apparatus according to claim 4, wherein a voltage of an opposite polarity to a charge polarity of the toner is applied to said first to fourth transfer members when the first to fourth toner images are transferred to said intermediary transfer belt, respectively.

10. An image forming apparatus comprising:

an image input portion into which image data corresponding to toner images to be formed is inputted;

a first image forming station including a first photosensitive member, a first charging roller configured to charge said first photosensitive member at a first charging position, a first exposure member configured to expose said first photosensitive member charged by said first charging roller to light on the basis of, among the image data inputted into said image input portion, first image data corresponding to a first toner image formed at said first image forming station, and a first developing device configured to develop with a toner an electrostatic latent image formed on said first photosensitive member by said first exposure member;

a second image forming station including a second photosensitive member, a second charging roller configured to charge said second photosensitive member at a second charging position by being supplied with only a DC voltage, a second exposure member configured to expose said second photosensitive member charged by said second charging roller to light on the basis of, among the image data inputted into said image input portion, second image data corresponding to a second toner image formed at said second image forming station, and a second developing device configured to develop with a toner an electrostatic latent image formed on said second photosensitive member by said second exposure member;

a third image forming station including a third photosensitive member, a third charging roller configured to charge said third photosensitive member at a third charging position by being supplied with only a DC voltage, a third exposure member configured to expose said third photosensitive member charged by said third charging roller to light on the basis of, among the image data inputted into said image input portion, third image data corresponding to a third toner image formed at said third image forming station, and a third developing device configured to develop with a toner an electrostatic latent image formed on said third photosensitive member by said third exposure member;

a fourth image forming station including a fourth photosensitive member, a fourth charging roller configured to charge said fourth photosensitive member at a fourth charging position by being supplied with only a DC voltage, a fourth exposure member configured to expose said fourth photosensitive member charged by said fourth charging roller to light on the basis of, among the image data inputted into said image input portion, fourth image data corresponding to a fourth toner image formed at said fourth image forming station, and a fourth developing device configured to develop with a toner an electrostatic latent image formed on said fourth photosensitive member by said fourth exposure member;

an intermediary transfer belt configured to bear the first toner image, the second toner image, the third toner image and the fourth toner image which are transferred superposedly in the listed order;

a first transfer member disposed opposed to said first photosensitive member via said intermediary transfer belt and configured to electrostatically transfer the first toner image formed on said first photosensitive member onto said intermediary transfer belt at a first transfer position;

a second transfer member disposed opposed to said second photosensitive member via said intermediary transfer belt and configured to electrostatically transfer the second toner image formed on said second photosensitive member onto said intermediary transfer belt at a second transfer position;

a third transfer member disposed opposed to said third photosensitive member via said intermediary transfer belt and configured to electrostatically transfer the third toner image formed on said second photosensitive member onto said intermediary transfer belt at a third transfer position; and a fourth transfer member disposed opposed to said fourth photosensitive member via said intermediary transfer belt and configured to electrostatically transfer the fourth toner image formed on said fourth photosensitive member onto said intermediary transfer belt at a fourth transfer position, wherein said first image forming station is not provided with a pre-exposure member configured to expose said first photosensitive member to light at a position downstream of the first transfer position and upstream of the first charging position with respect to a movement direction of said first photosensitive member, and said second image forming station, said third image forming station and said fourth image forming station are provided with a first pre-exposure member, a second pre-exposure member, and a third pre-exposure member, respectively, configured to expose corresponding ones of said photosensitive members to light, at a position downstream of the second transfer position and upstream of the second charging position with respect to a movement direction of said second photosensitive member, at a position downstream of the third transfer position and upstream of the third charging position with respect to a movement direction of said third photosensitive member and at a position downstream of the fourth transfer position and upstream of the fourth charging position with respect to a movement direction of said fourth photosensitive member, respectively.

11. An image forming apparatus according to claim 10, comprising a controller configured to control an operation of said first pre-exposure member depending on the first image data.

12. An image forming apparatus according to claim 11, wherein said controller actuates said first pre-exposure member when a toner amount corresponding to the first image data is not less than a predetermined amount and does not actuate said first pre-exposure member when the toner amount corresponding to the first image data is less than the predetermined amount.

13. An image forming apparatus according to claim 10, comprising a controller configured to control an operation of said second pre-exposure member depending on the first image data and the second image data.

14. An image forming apparatus according to claim 13, wherein said controller actuates said second pre-exposure member when a sum of a toner amount corresponding to the first image data and a toner amount corresponding to the second image data is not less than a predetermined amount and does not actuate said second pre-exposure member when the sum is less than the predetermined amount.

15. An image forming apparatus according to claim 10, comprising a controller configured to control an operation of said third pre-exposure member depending on the first image data, the second image data and the third image data.

16. An image forming apparatus according to claim 15, wherein said controller actuates said third pre-exposure member when a sum of a toner amount corresponding to the first image data, a toner amount corresponding to the second image data and a toner amount corresponding to the third image data is not less than a predetermined amount and does not actuate said third pre-exposure member when the sum is less than the predetermined amount.

17. An image forming apparatus according to claim 10, wherein a voltage of an opposite polarity to a charge polarity of the toner is applied to said first to fourth transfer members when the first to fourth toner images are transferred to said intermediary transfer belt, respectively.

* * * * *